US008308195B1

(12) United States Patent
Smith, Jr.

(10) Patent No.: US 8,308,195 B1
(45) Date of Patent: Nov. 13, 2012

(54) SMALL BOOK FABRICATION SYSTEM

(76) Inventor: Charles E. Smith, Jr., Richardson, TX (US)

( * ) Notice: Subject to any disclaimer, the term of this patent is extended or adjusted under 35 U.S.C. 154(b) by 0 days.

(21) Appl. No.: 13/490,493

(22) Filed: Jun. 7, 2012

Related U.S. Application Data

(62) Division of application No. 13/200,001, filed on Sep. 15, 2011.

(51) Int. Cl.
*B42D 1/00* (2006.01)
*B42D 5/00* (2006.01)
*B42C 9/00* (2006.01)

(52) U.S. Cl. ..... 281/41; 281/38; 281/40; 412/1

(58) Field of Classification Search ..... 281/41, 281/38, 40; 412/1; 270/21.1, 52.17, 58.07
See application file for complete search history.

(56) References Cited

U.S. PATENT DOCUMENTS 3,843,113 A * 10/1974 Schaffer ..... 281/38
4,564,470 A * 1/1986 Schmitt ..... 270/21.1

OTHER PUBLICATIONS http://www.12on14.com/pp./templates.htm (2008).*
http://www.americangreetings.com/printable-cards/just-because/pn/3172482.

* cited by examiner

*Primary Examiner* — Dana Ross
*Assistant Examiner* — Kyle Grabowski

(57) ABSTRACT

The first step is fabricating a sheet with a front face divided into 4 quadrants; a rear face divided into 4 quadrants; upper and lower edges separated by a height; first and second side edges separated by a width; a central vertical fold line; and a central horizontal fold line. The next step is forming an image on each quadrant. The next step is creating a first fold along the vertical fold line and a second fold along the horizontal fold line. The next step is coupling the quadrants adjacent to the vertical fold line using a tape. The final step is cutting along the horizontal fold line to crop and remove the horizontal fold line creating a first signature having pages 1 through 8.

1 Claim, 3 Drawing Sheets

FIG. 1
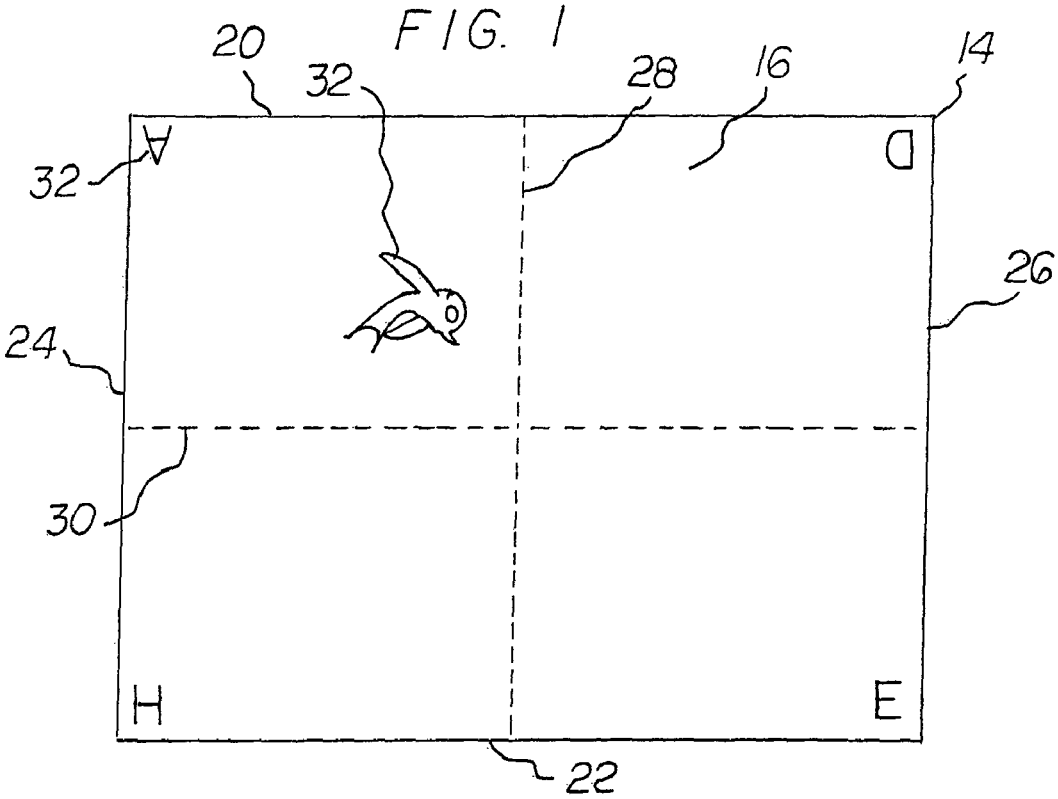
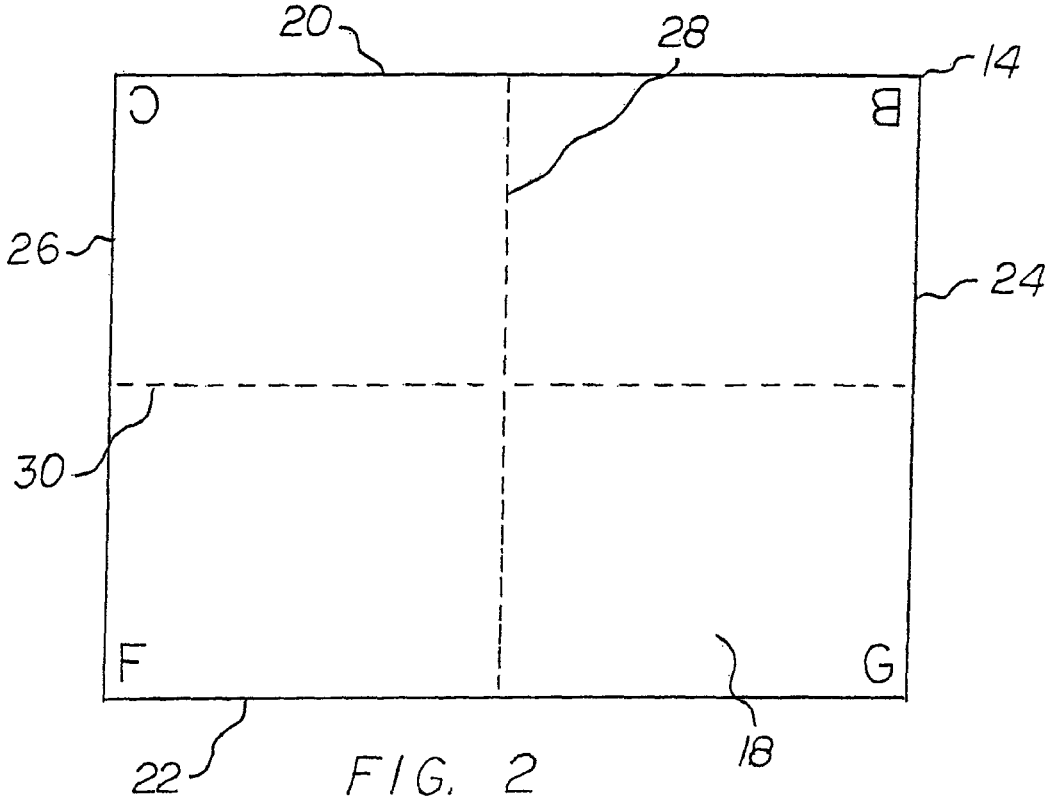
FIG. 2

FIG. 6
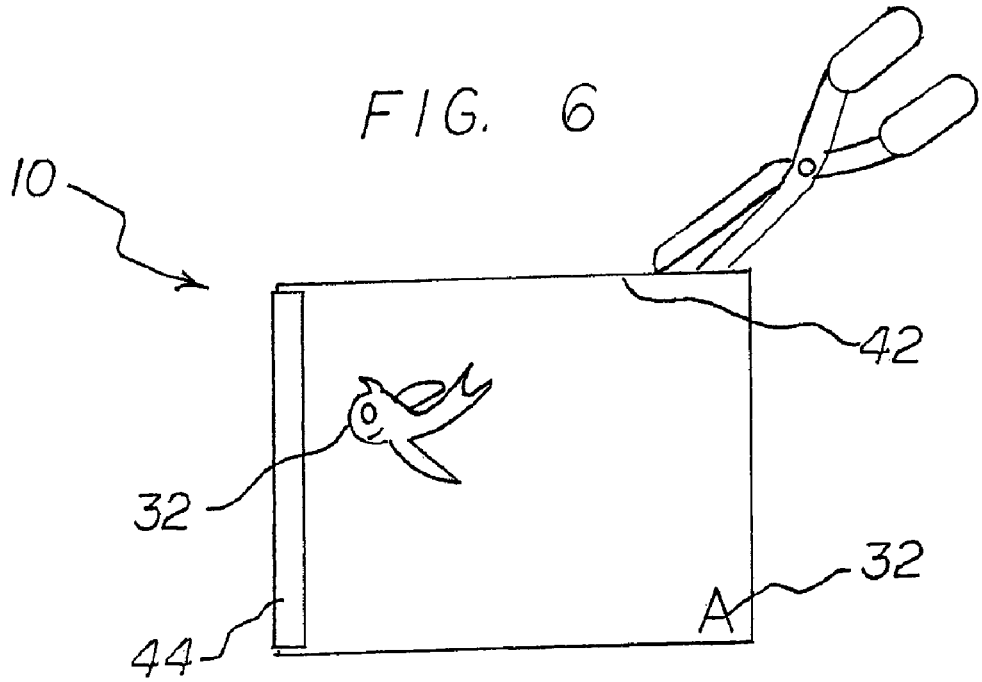
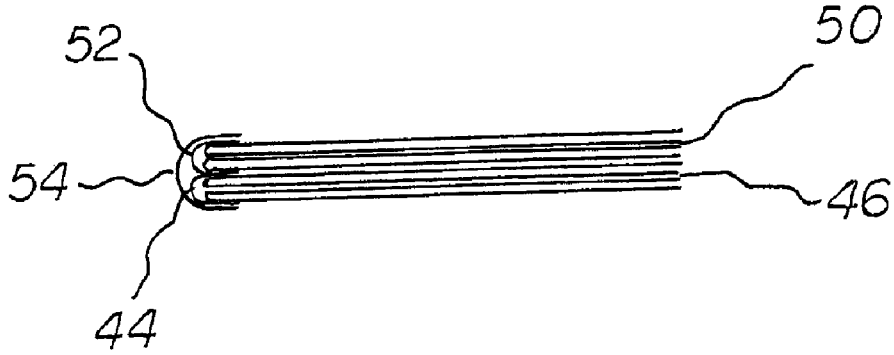
FIG. 5

SMALL BOOK FABRICATION SYSTEM

RELATED APPLICATION

This application is a division of application Ser. No. 13/200,001 filed Sep. 15, 2011 entitled "Small Book System and Fabrication Method," the subject matter of which is incorporated herein by reference.

BACKGROUND OF THE INVENTION

Field of the Invention

The present invention relates to a small book system and fabrication method and more particularly pertains to simplifying the design of small books and for facilitating the construction of such small books, the design and the construction being done in a safe, simple, convenient and economical manner.

SUMMARY OF THE INVENTION

In view of the foregoing disadvantages inherent in the known types of book systems of known designs and configurations now present in the prior art, the present invention provides an improved small book system and fabrication method. As such, the general purpose of the present invention, which will be described subsequently in greater detail, is to provide a new and improved small book system and fabrication method which has all the advantages of the prior art and none of the disadvantages.

To attain this, the present invention essentially comprises a small book system and fabrication method. First provided is a sheet of paper. The sheet of paper has a front face. The sheet of paper has a rear face. The sheet of paper has an upper edge. The sheet of paper has a parallel lower edge. The upper and lower edges are separated by a height. The sheet of paper has a first side edge. The sheet of paper has a parallel second side edge. The side edges are separated by a width. The sheet of paper has a vertical fold line. The vertical fold line is provided parallel with and midway between the side edges. The sheet of paper has a horizontal fold line. The horizontal fold line is provided parallel with and midway between the upper and lower edges. The upper and lower edges and horizontal fold line have the same horizontal length. The side edge and vertical fold line have the same vertical length. The length of the side edge and vertical fold line is less than the horizontal length. It should be understood that the horizontal height is adapted to be greater than the vertical width for creating a portrait configured book rather than the landscape configured book as shown.

The front face is divided into 4 quadrants. The quadrants include an upper left quadrant A, an upper right quadrant D, a lower left quadrant H and a lower right quadrant E. Quadrant A constitutes page 1. Quadrant D constitutes page 4. Quadrant H constitutes page 8. Quadrant E constitutes page 5.

The rear face is divided into 4 quadrants. The quadrants include an upper left quadrant C, an upper right quadrant B, a lower left quadrant F and a lower right quadrant G. Quadrant C constitutes page 3. Page 3 is on the reverse of page 4. Quadrant B constitutes page 2. Page 2 is on the reverse of page 1. Quadrant F constitutes page 6. Page 6 is on the reverse of page 5. Quadrant G constitutes page 7. Page 7 is opposite of page 8.

An image is formed on each quadrant. The images of quadrants H, E, F and G are right reading. The images of quadrants A, D, C and B are inverted.

A first fold is provided. The first fold has a deep crease along the vertical fold line. Quadrant B is in facing contact with quadrant C. Quadrant G is in contact with quadrant F.

A second fold is provided. The second fold line has a deep crease along the horizontal fold line. Quadrant D is in facing contact with quadrant E.

Further provided is a first adhesive tape. The first adhesive tape is provided in contact with and couples quadrants A and H adjacent to the vertical fold line. In this manner a first signature of a plural signature book is provided. The first signature includes pages 1 through 8.

Provided next is a second signature. The second signature is of the same construction as the first signature. The second signature includes pages 9 through 16. A second adhesive tape is provided. An enlarger adhesive tape is provided. The enlarger adhesive tape is provided in contact with the first and second adhesive tapes.

Provided last is a cut parallel with and closely spaced from the horizontal fold line. In this manner the horizontal fold line is cropped and removed. In this manner a multiple signature small book system is formed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways such as fewer or more folds, as for example, one less or one more fold prior to taping/binding and cutting/cropping. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved small book system and fabrication method which has all of the advantages of the prior art book systems of known designs and configurations and none of the disadvantages.

It is another object of the present invention to provide a new and improved small book system and fabrication method which may be easily and efficiently manufactured and marketed.

It is further object of the present invention to provide a new and improved small book system and fabrication method which is of durable and reliable constructions.

An even further object of the present invention is to provide a new and improved small book system and fabrication method which is susceptible of a low cost of manufacture with regard to both materials and labor, and which accordingly is then susceptible of low prices of sale to the consuming public, thereby making such small book system and fabrication method economically available to the buying public.

Even still another object of the present invention is to provide a small book system and fabrication method for simplifying the design of small books and for facilitating the construction of such small books by individuals, including young and old.

Even still another object of the present invention is to provide a small book system and fabrication method for simplifying the design of small books and for facilitating the construction of such small books, the design and the construction being done in a safe, simple, convenient and economical manner.

Lastly, it is an object of the present invention to provide a new and improved small book system and fabrication method. A sheet has front and rear faces and upper and lower edges. The upper and lower edges are separated by a height. The sheet has first and second side edges. The side edges are separated by a width. The sheet has a central vertical fold line and a central horizontal fold line. The front face is divided into 4 quadrants. The rear face is divided into 4 quadrants. An image is formed on each quadrant. A first fold is provided along the vertical fold line and a second fold is provided along the horizontal fold line. A tape couples the quadrants adjacent to the vertical fold line. A cut is provided along the horizontal fold line. In this manner the horizontal fold line is cropped and removed. In this manner a first signature is created. The first signature has pages 1 through 8.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a first side of a first sheet of a small book system prior to folding.

FIG. 2 is a front elevational view of a second side of the first sheet prior to folding.

FIG. 5 is a side elevational view of a fully assembled small book system constructed of two sheets, 16 pages.

FIG. 6 is a perspective illustration of the first sheet being cut along the horizontal fold line.

The same reference numerals refer to the same parts throughout the various Figures.

DESCRIPTION OF THE PREFERRED EMBODIMENT

Figure 3:
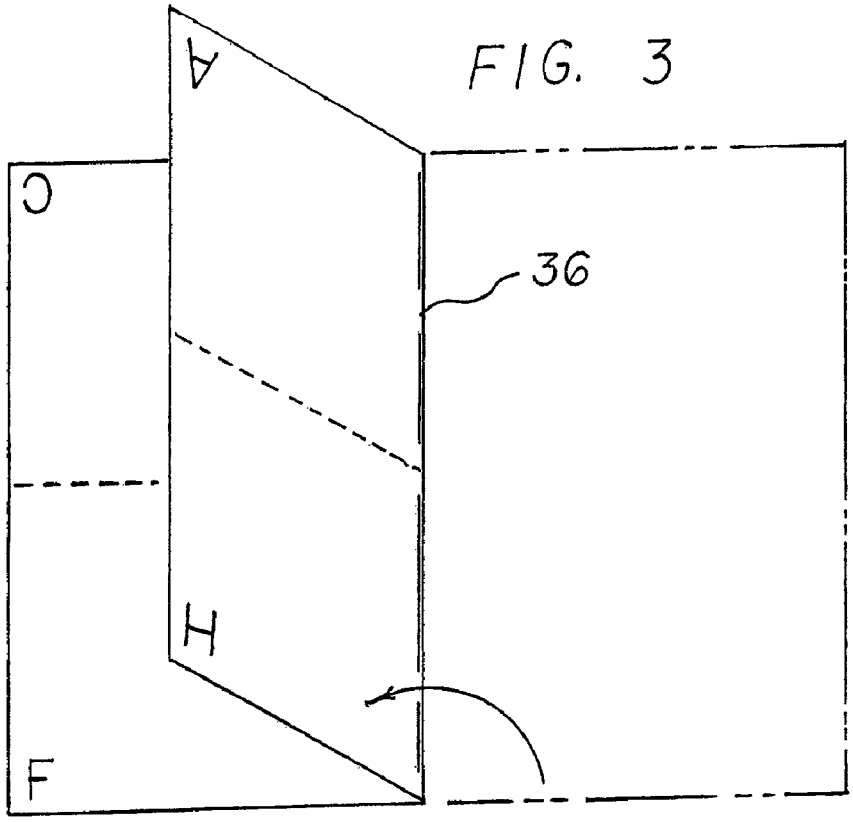
FIG. 3 is a perspective illustration of the first sheet receiving a vertical first fold.
Figure 4:
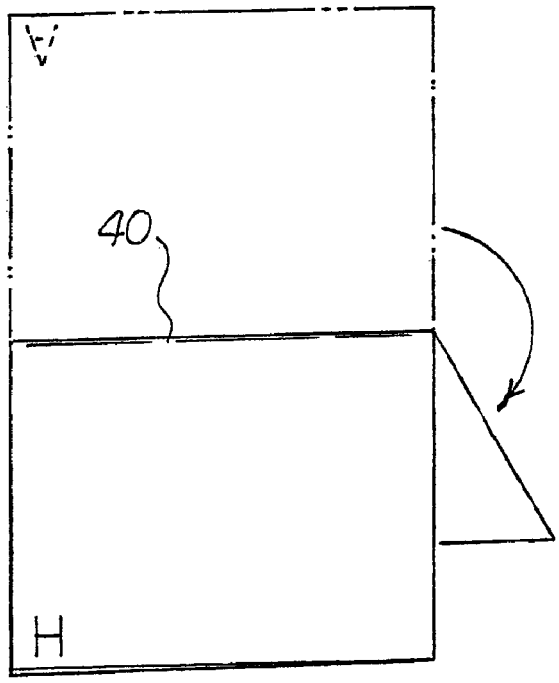
FIG. 4 is a perspective illustration of the first sheet receiving a horizontal second fold.

With reference now to the drawings, and in particular to FIG. 1 thereof, the preferred embodiment of the new and improved small book system and fabrication method embodying the principles and concepts of the present invention and generally designated by the reference numeral 10 will be described.

The present invention, the small book system and fabrication method 10 is comprised of a plurality of components. Such components in their broadest context include a sheet, an image, a first fold, a cut/crop and a tape/binding. Such components are individually configured and correlated with respect to each other so as to attain the desired objective.

First provided is a sheet of paper 14. The sheet of paper has a front face 16. The sheet of paper has a rear face 18. The sheet of paper has an upper edge 20. The sheet of paper has a parallel lower edge 22. The upper and lower edges are separated by a height. The sheet of paper has a first side edge 24. The sheet of paper has a parallel second side edge 26. The side edges are separated by a width. The sheet of paper has a vertical fold line 28. The vertical fold line is provided parallel with and midway between the side edges. The sheet of paper has a horizontal fold line 30. The horizontal fold line is provided parallel with and midway between the upper and lower edges. The upper and lower edges and horizontal fold line have the same horizontal length. The side edge and vertical fold line have the same vertical length. The length of the side edge and vertical fold line is less than the horizontal length. It should be understood that the horizontal height is adapted to be greater than the vertical width for creating a portrait configured book rather than the landscape configured book as shown. For a portrait signature, the first fold line must be made along the longest dimension.

The front face is divided into 4 quadrants. The quadrants include an upper left quadrant A, an upper right quadrant D, a lower left quadrant H and a lower right quadrant E. Quadrant A constitutes page 1. Quadrant D constitutes page 4. Quadrant H constitutes page 8. Quadrant E constitutes page 5.

The rear face is divided into 4 quadrants. The quadrants include an upper left quadrant C, an upper right quadrant B, a lower left quadrant F and a lower right quadrant G. Quadrant C constitutes page 3. Page 3 is on the reverse of page 4. Quadrant B constitutes page 2. Page 2 is on the reverse of page 1. Quadrant F constitutes page 6. Page 6 is on the reverse of page 5. Quadrant G constitutes page 7. Page 7 is opposite of page 8.

An image 32 is formed on each quadrant. The images of quadrants H, E, F and G are right reading. The images of quadrants A, D, C and B are inverted.

A first fold 36 is provided. The first fold has a deep crease along the vertical fold line. Quadrant B is in facing contact with quadrant C. Quadrant G is in contact with quadrant F.

A second fold 40 is provided. The second fold line has a deep crease along the horizontal fold line. Quadrant D is in facing contact with quadrant E.

Further provided is a first adhesive tape 44. The first adhesive tape is provided in contact with and couples quadrants A and H adjacent to the vertical fold line. In this manner a first signature 46 of a plural signature book is provided. The first signature includes pages 1 through 8.

Provided next is a second signature 50. The second signature is of the same construction as the first signature. The second signature includes pages 9 through 16. A second adhesive tape 52 is provided. An enlarger adhesive tape 54 is provided. The enlarger adhesive tape is provided in contact with the first and second adhesive tapes. In this manner a multiple signature small book system is formed.

It should be understood that the adhesive tape is the preferred embodiment for coupling purposes. A wide variety of other coupling means could readily be utilized including staples, clips, bindings, stitching and the like.

It should be further understood that a larger plurality of signatures are adapted to be utilized together with appropriate coupling means for joining together the plurality of signatures.

Provided last is a cut 42 parallel with and closely spaced from the horizontal fold line. In this manner the horizontal fold line is cropped and removed.

The present invention also includes a small book fabrication method.

The first step is providing a sheet of paper 14. The sheet of paper has a front face 16. The sheet of paper has a rear face 18. The sheet of paper has an upper edge 20. The sheet of paper has a parallel lower edge 22. The upper and lower edges are separated by a height. The sheet of paper has a first side edge 24. The sheet of paper has a parallel second side edge 26. The side edges are separated by a width. The sheet of paper has a vertical fold line 28. The vertical fold line is provided parallel with and midway between the side edges. The sheet of paper has a horizontal fold line 30. The horizontal fold line is provided parallel with and midway between the upper and lower edges. The upper and lower edges and horizontal fold line have the same horizontal length. The side edge and vertical fold line have the same vertical length. The length of the side edge and vertical fold line is less than the horizontal length. It should be understood that the horizontal height is adapted to be greater than the vertical width for creating a portrait configured book rather than the landscape configured book as shown.

The second step is dividing the front face into 4 quadrants. The quadrants include an upper left quadrant A, an upper right quadrant D, a lower left quadrant H and a lower right quadrant E. Quadrant A constitutes page 1. Quadrant D constitutes page 4. Quadrant H constitutes page 8. Quadrant E constitutes page 5.

The third step is dividing the rear face is divided into 4 quadrants. The quadrants include an upper left quadrant C, an upper right quadrant B, a lower left quadrant F and a lower right quadrant G. Quadrant C constitutes page 3. Page 3 is on the reverse of page 4. Quadrant B constitutes page 2. Page 2 is on the reverse of page 1. Quadrant F constitutes page 6. Page 6 is on the reverse of page 5. Quadrant G constitutes page 7. Page 7 is opposite of page 8.

The fourth step is forming an image 32 on each quadrant. The images of quadrants H, E, F and G are right reading. The images of quadrants A, D, C and B are inverted.

The fifth step is folding the sheet. A first fold 36 is provided. The first fold has a deep crease along the vertical fold line. Quadrant B is in facing contact with quadrant C. Quadrant G is in contact with quadrant F.

The sixth step is folding the sheet in a second fold 40. The second fold line has a deep crease along the horizontal fold line. Quadrant D is in facing contact with quadrant E.

The seventh step is placing a first adhesive tape 44. The first adhesive tape is provided in contact with and couples quadrants A and H adjacent to the vertical fold line. In this manner a first signature 46 of a plural signature book is provided. The first signature includes pages 1 through 8.

The last step is cutting. Provided next is a cut 42 parallel with and closely spaced from the horizontal fold line. In this manner the horizontal fold line is cropped and removed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A small book fabrication method for simplifying the design of small books and for facilitating the construction of such small books, the design and the construction being done in a safe, simple, convenient and economical manner, the method comprising the steps of:

providing a sheet of paper (14) having a front face (16) and a rear face (18), the sheet having an upper edge (20) and a parallel lower edge (22) separated by a height, the sheet of paper having a first side edge (24) and a parallel second side edge (26) separated by a width, the sheet having a vertical fold line (28) parallel with and midway between the side edges, the sheet having a horizontal fold line (30) parallel with and midway between the upper and lower edges, the upper and lower edges and horizontal fold line having the same horizontal length, the side edge and vertical fold line having the same vertical length less than the horizontal length;

dividing the front face into 4 quadrants, an upper left quadrant A constituting page 1, an upper right quadrant D constituting page 4, a lower left quadrant H constituting page 8 and a lower right quadrant E constituting page 5;

dividing the rear face into 4 quadrants, an upper left quadrant C constituting page 3 on the reverse of page 4, an upper right quadrant B constituting page 2 on the reverse of page 1, a lower left quadrant F constituting page 6 on the reverse of page 5 and a lower right quadrant G constituting page 7 opposite of page 8;

forming an image (32) on each quadrant, the images of quadrants H, E, F and G being right reading, the images of quadrants A, D, C and B being inverted;

folding the sheet with a first fold (36) with a deep crease along the vertical fold line with quadrant B in facing contact with quadrant C and with quadrant G in contact with quadrant F;

folding the sheet with a second fold (40) with a deep crease along the horizontal fold line with quadrant D in facing contact with quadrant E;

placing a first adhesive tape (44) in contact with and coupling quadrants A and H adjacent to the vertical fold line to thereby create a small book system including pages 1 through 8; and cutting (42) parallel with and closely spaced from the horizontal fold line thus cropping and removing the horizontal fold line.

* * * * *